US008106322B2

(12) United States Patent
Fleege

(10) Patent No.: US 8,106,322 B2
(45) Date of Patent: Jan. 31, 2012

(54) FLEXIBLE NON-FRANGIBLE AMPERAGE FLAG FOR MOLDED CASE CIRCUIT BREAKERS

(75) Inventor: Dennis W. Fleege, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 233 days.

(21) Appl. No.: 12/607,476

(22) Filed: Oct. 28, 2009

(65) Prior Publication Data

US 2011/0094863 A1 Apr. 28, 2011

(51) Int. Cl.
*H01H 9/00* (2006.01)

(52) U.S. Cl. ..... 200/308

(58) Field of Classification Search ..... 200/308; 335/17

See application file for complete search history.

(56) References Cited

U.S. PATENT DOCUMENTS

| | | | | |
|---|---|---|---|---|
| 4,382,270 | A * | 5/1983 | Davidson et al. | 361/115 |
| 4,698,606 | A * | 10/1987 | Mrenna et al. | 335/45 |
| 6,246,304 | B1 * | 6/2001 | Gasper | 335/17 |
| 6,897,747 | B2 * | 5/2005 | Brandon et al. | 335/17 |
| 7,135,945 | B2 * | 11/2006 | Whipple et al. | 335/17 |

FOREIGN PATENT DOCUMENTS

| | | |
|---|---|---|
| EP | 0591073 A1 | 9/1993 |
| EP | 2079091 A1 | 7/2009 |

OTHER PUBLICATIONS http://www.pioneerbreaker.com/ProductDetails.asp?ProductCode=HKA3225T.*

Written Opinion corresponding to International Patent Application No. PCT/US2010/054271, European Patent Office, dated Jan. 18, 2011, 5 pages.

International Search Report corresponding to International Patent Application No. PCT/US2010/054271, European Patent Office, dated Jan. 18, 2011, 4 pages.

* cited by examiner

*Primary Examiner* — Vanessa Girardi

(57) ABSTRACT

A flexible amperage flag that indicates an amperage rating of a trip unit in a circuit breaker. The flag is molded with a housing of the trip unit so that it remains with the trip unit even when installed into a different circuit breaker. The flag includes an attachment member secured to a wall of the trip unit and a flexible leg integral with the attachment member. A top surface member indicates the amperage rating and protrudes through an auxiliary cover of the circuit breaker so as to be visible through the panelboard into which the circuit breaker is installed and is connected to the top surface member. During a circuit interruption, the pressure created by the exploding gas forces the auxiliary cover away from the trip unit, creating stress on the flag. The flexible leg permits the flag to move with the auxiliary cover and return to its original form without breaking. The flag can also include a second leg that prevents movement of a hammer of the trip unit out of its pre-assembled position during assembly of the circuit breaker.

14 Claims, 3 Drawing Sheets

FLEXIBLE NON-FRANGIBLE AMPERAGE FLAG FOR MOLDED CASE CIRCUIT BREAKERS

FIELD OF THE INVENTION

The present disclosure relates to circuit breakers, and, more particularly, to a flexible amperage flag in a circuit breaker.

BACKGROUND

Amperage flags are used in some circuit breakers to indicate the amperage rating of a circuit breaker. The rating is typically printed on an exposed, visible surface of the flag that protrudes from an auxiliary cover of the circuit breaker. These flags must be visible from an exterior of the circuit breaker and also through the panelboard trim when installed into a panelboard. The auxiliary cover of the circuit breaker is also visible through an opening in the panelboard trim. The visible nature of the amperage flag allows visual inspection of the panelboard by an operator to ascertain the amperage rating of the circuit breaker by reading the rating printed on the amperage flag.

FIG. 1 illustrates an isometric view of a portion of a circuit breaker 100 that includes a conventional trip unit 102 that trips the circuit breaker 100 in response to detection of an electrical fault, such as a ground fault, a short circuit, and the like, breaking the electrical connection between the line current and the load to which the circuit breaker 100 is connected. Conventionally, a trip mechanism in the circuit breaker 100 operates a set of movable contacts that can interrupt electrical current flowing through the trip unit 102.

An amperage flag 106 is attached to a wall 116 of the trip unit 102 via an attachment member 114. A cutaway portion of an auxiliary cover 104 that houses components of the circuit breaker 100 is shown in phantom lines to show the amperage flag 106 in clear detail. The amperage flag 106 can include ribs to strengthen the attachment of the amperage flag 106 to the wall 116 of the trip unit 102.

When certain electrical faults occur, such as a short circuit that produces high electrical current, large arcs can be created generating high gas pressure inside the circuit breaker 100. The gas pressure expands in all directions, causing high stresses in the plastic housings of the circuit breaker 100.

During interruption of the current, the gas pressure pushes the trip unit 102 and the auxiliary cover 104 in opposite directions from one another, creating a stress point at the interface between the trip unit 102 and the auxiliary cover 104. As a result, the amperage flag 106 undesirably cracks or breaks at this interface, even with the stiffening ribs 112. The flag 106 can fall inside the circuit breaker 100 when it breaks, disappearing from view and potentially interfering with the operation of the circuit breaker. It would be desirable to have an amperage flag that does not crack or break (i.e., is non-frangible) during interruption of the circuit breaker.

During assembly of some circuit breakers, a hammer is installed in the trip unit. A solenoid activates this hammer in response to detection of an electrical fault, and the hammer rotates to engage a trip mechanism of the circuit breaker, which causes a sequence of mechanical actions to trip the circuit breaker by separating the movable contacts and severing the electrical connections between the circuit breaker and the loads being protected. During assembly of such circuit breakers, the hammer can pop out of its position in the trip unit. It would be desirable to provide a way of ensuring that the hammer stays in its pre-assembled position during assembly of the trip unit so that it does not pop out of that position.

BRIEF SUMMARY

Compared to the prior-art amperage flags, which sought to reinforce the amperage flag to a trip unit of a circuit breaker, the amperage flag disclosed herein is attached more flexibly to the trip unit, allowing it to flex with excursions of the auxiliary cover through which the flag protrudes during circuit interruptions. As the contacts of the circuit breaker separate from one another, explosive gasses are produced, creating sudden, internal pressure inside the circuit breaker's housing. The auxiliary cover abuts against a trip unit housing, and the internal pressure causes the auxiliary cover to move away from the trip unit housing, taking with it the amperage flag. In prior-art designs, this flag was reinforced by adding ribs or making the flag thicker, in an effort to make the flag stronger and thus more resistant to excursions by the auxiliary cover away from the trip unit housing. But the flags were still subject to cracking or breaking, causing the top of the flag that bore the amperage rating for the trip unit to fall or break off, sometimes into the circuit breaker, taking with it the only visible indication of the amperage rating readily apparent to the operator. Because the trip units can be designed to be interchangeable among different circuit breaker housings or frames, losing the amperage rating flag is undesirable.

The amperage flag disclosed herein is made more flexible, by thinning its walls, making it of a flexible material like plastic, and positioning it a distance away from the trip unit by an attachment member. The top surface member indicates the amperage rating and is attached to a flexible leg that is attached to the attachment member. The entire trip unit housing together with the amperage flag can be molded from a single mold to form a single piece. This ensures that the proper amperage flag always stays with the trip unit housing. The flexibility of the amperage flag allows it to flex like a spring during circuit interruptions and to move with the auxiliary cover as it is force away from the trip unit, then return to its original position and form when the interruption has completed. Thus, by making the amperage flag more flexible instead of trying to reinforce it and make it stronger, the disclosed amperage flag is more resistant to breakage or cracking.

In some electronic circuit breakers that include a solenoid-actuated hammer that engages a trip mechanism for tripping the circuit breaker, the amperage flag can also include a leg member that is positioned and dimensioned to keep the hammer from popping out of its pre-assembled position during assembly of the circuit breaker. The leg member acts like a finger keeping the hammer in position during assembly, because it has a tendency to pop out of position and when installed incorrectly can lead to incorrect trip unit operation or trip unit malfunction. Because the hammer is needed to engage the trip mechanism, which ultimately causes the movable contacts of the circuit breaker to separate from one another, it is important for the hammer to be correctly positioned within the trip unit during assembly of the circuit breaker and prior to operational deployment of the circuit breaker.

BRIEF DESCRIPTION OF THE DRAWINGS

The foregoing and other advantages of the invention will become apparent upon reading the following detailed description and upon reference to the drawings.

Figure 1:
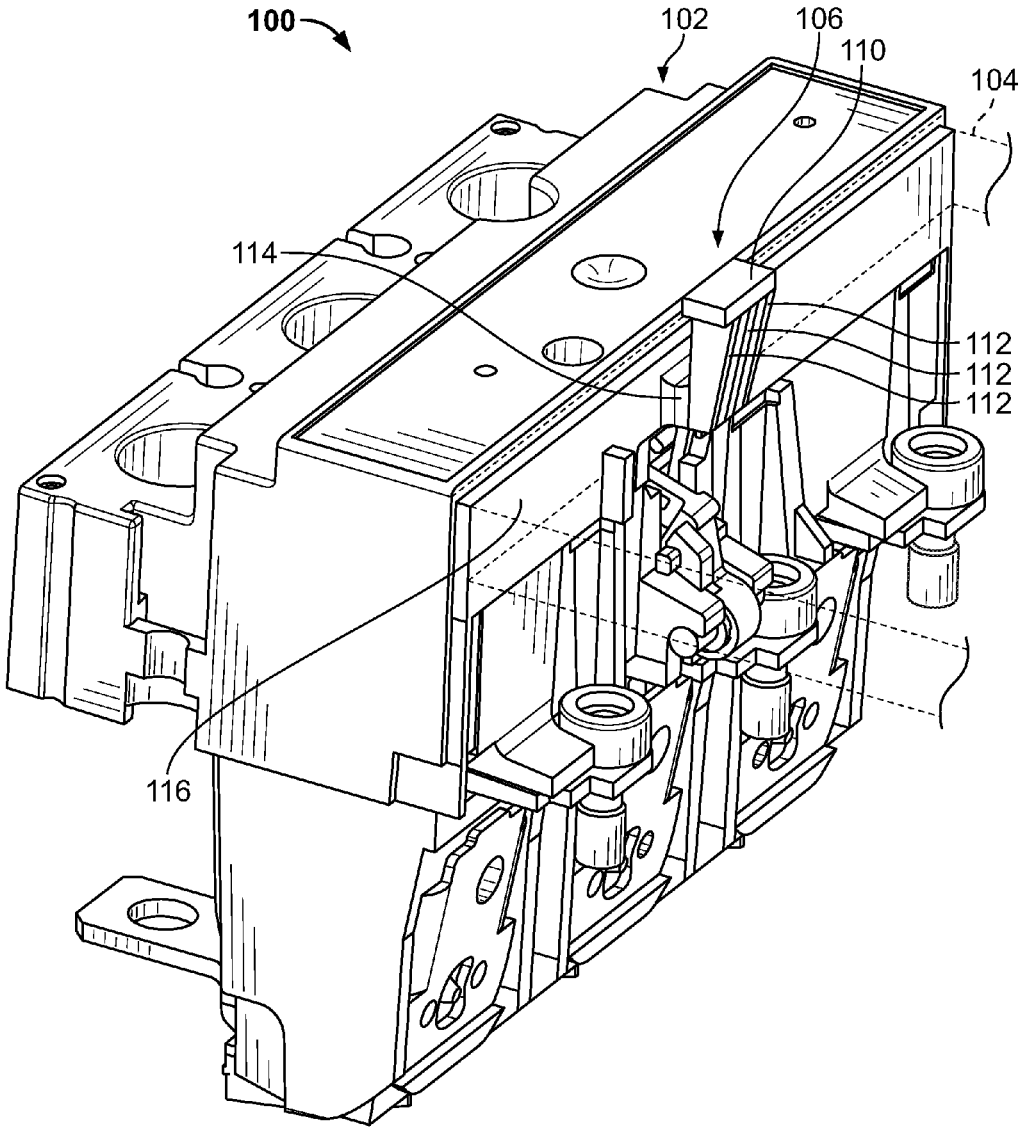
FIG. 1 (Prior Art)
FIG. 1 is an isometric view of a trip unit of a conventional circuit breaker having a prior-art amperage flag.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Figure 2:
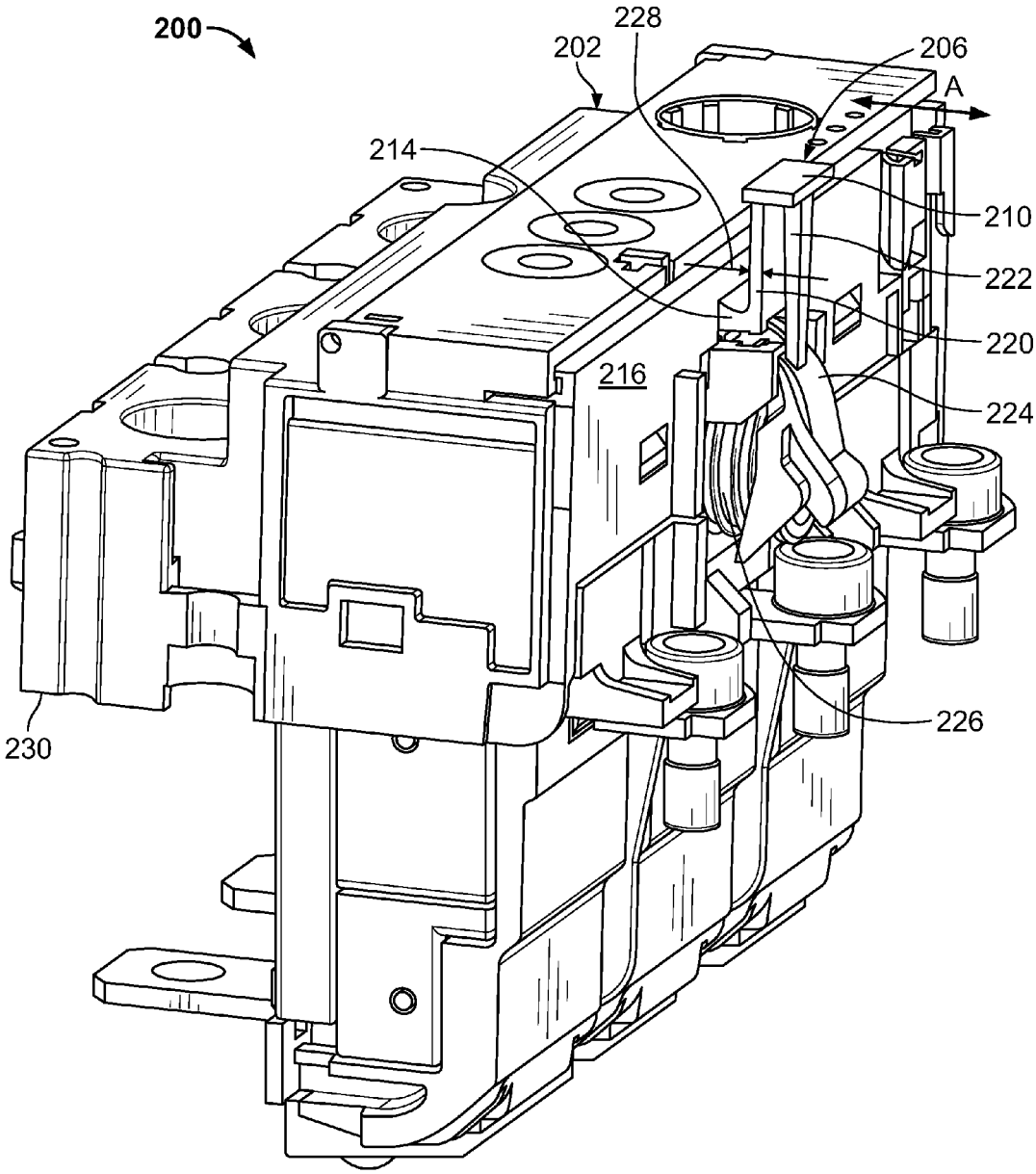
FIG. 2 is an isometric view of a trip unit of a circuit breaker having a flexible amperage flag according to the present disclosure.

FIG. 2 is an isometric view of a trip unit 202 of a molded-case circuit breaker 200 incorporating a flexible amperage flag 206 according to an aspect of the present disclosure. The trip unit 202 conventionally causes movable contacts (not shown) within the circuit breaker 200 to separate in response to detection of an electrical fault, thereby interrupting the flow of electrical current through the circuit breaker 200 to electrical loads protected by the circuit breaker 200. In response to the circuit interruption, a significant amount of arcing can occur inside the circuit breaker 200, which produces high internal gas pressures. The gas pressure causes the trip unit 202 and an auxiliary cover 204 (seen in FIG. 3) to move in opposite directions from one another, indicated by the double-arrowed line A in FIG. 2. Because the amperage flag 206 sits right at the interface 218 (FIG. 3) between the trip unit 202 and the auxiliary cover 204, it is prone to stress and movement during an arcing explosion as the auxiliary cover 204 through which the flag 206 protrudes. The flexible amperage flag 206 is attached to a wall 216 of the trip unit 202 by an attachment member 214 as shown. The wall 216 extends along one plane, and the attachment member 214 extends away from that plane. The flexible amperage flag 206 further includes a first flexible leg 220 coupled to the attachment member 214 and a second leg 222. Both legs 220, 222 are parallel to one another and are coupled to a top surface member 210 of the flexible amperage flag 206.

The flexible amperage flag 206 can be an integrated component made of molded plastic, or it can comprise multiple components secured together to form the amperage flag 206. The leg 220 is flexible and has a thickness 228 sufficient to permit them to flex without breaking or cracking in response to excursions of the auxiliary cover 204 away from the trip unit 202 at the interface 218. In a specific example, the flexible leg 220 has a thickness of 0.06 inches. When flexed, the amperage flag 206 operates like a spring, springing back to its original position and form after being displaced. It has been found that the flexible arrangement of the amperage flag 206 eliminates the cracking and breaking that occurred in prior-art amperage flags. The leg 220 also has a length that is longer than its width, as shown in FIG. 2. The length of the leg 220 is parallel to the wall 216 of the trip unit 202. The wall 216 of the trip unit is oriented in a first plane, and the attachment member 214 extends away from the wall in a second direction that is generally orthogonal to the first plane. The attachment member 214 permits the leg 220 to flex in a direction toward the wall 216 and is spaced so that the flexible amperage flag 206 can protrude through a corresponding aperture in the auxiliary cover 204.

The trip unit 202 includes a molded plastic housing 230, which includes the wall 216 and the amperage flag 206. The molded plastic housing is molded as a single component or piece of plastic. Attaching the flag 206 to the trip unit 202 ensures that the amperage flag 206 travels with the trip unit 202 when the trip unit 202 is removed from the circuit breaker 200 and installed into a different circuit breaker. Alternately, the amperage flag 206 can be formed as a separate component and attached to the wall 216 of the trip unit 202 in any conventional manner. Although the amperage flag 206 is preferably made of plastic, it can be made of metal, such as steel, or any other material that is flexible.

The amperage flag 206 further includes a second leg 222, which keeps a hammer 224 of the trip unit 202 from moving out of position during assembly of the circuit breaker 200. If the hammer 224 moves in an upward direction during assembly, the circuit breaker 200 will be assembled incorrectly. The second leg 222 has a length that is operable to keep the hammer 224 from moving out of its pre-assembled position during assembly of the circuit breaker 200. Note that only the first leg 220 is needed for preventing the amperage flag 206 from breaking or cracking during a circuit interruption. The second leg 222 is operable to keep the hammer from moving out of position during assembly. Note that the second leg 222 does not prevent the hammer from rotating, as the hammer needs to rotate counterclockwise when activated by a plunger of a solenoid 226 in the trip unit 202, and engage a conventional trip mechanism (not shown) of the circuit breaker 200 that causes the movable contacts to separate, interrupting current to the load(s) that the circuit breaker 200 is protecting. Rather, the second leg 222 ensures that the hammer 224 does not pop out of place during assembly of the circuit breaker 200, yet does not prevent the normal operation of the hammer 224 during operation of the circuit breaker 200.

The second leg 222 also has a length longer than its width, and the length of the second leg 222 is generally parallel to the first flexible leg 220 and extends away from the top surface member 210 toward the hammer 224. The length of the second leg 222 has a dimension that extends from the top surface member 210 to the hammer 224. In a non-limiting example, the second leg 222 has a thickness slightly smaller than that of the first leg 220. In this example, the second leg 222 has a thickness of 0.05 inches, and is made of a flexible material. The second leg 222 has a length sufficient to prevent the hammer 224 from popping out of its pre-assembled position in the trip unit 202 during assembly of the circuit breaker 200.

Figure 3:
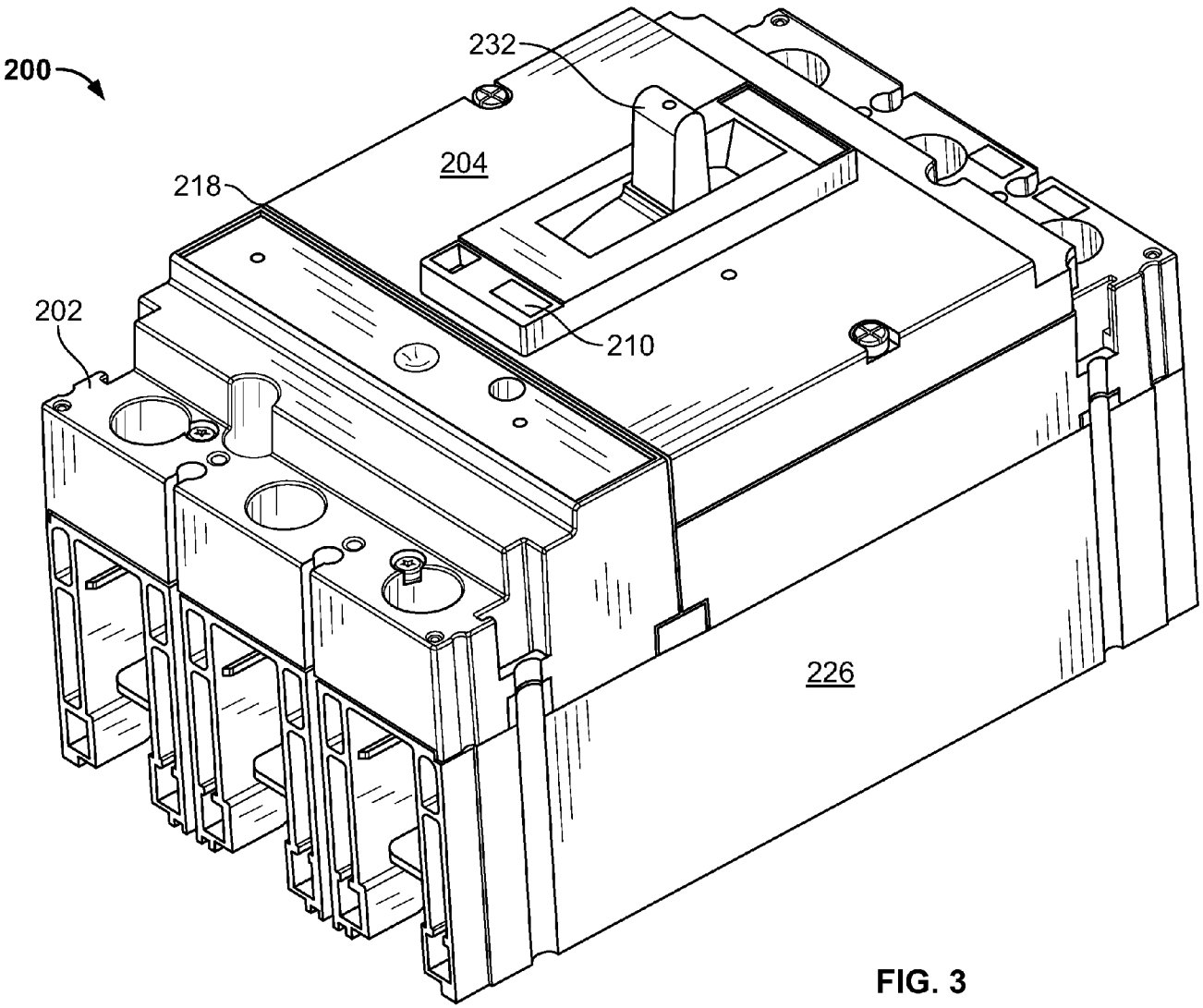
FIG. 3 is an isometric view of the circuit breaker of FIG. 2 with the auxiliary cover installed and the amperage flag protruding visibly through the auxiliary cover.

The top surface member 210 is visible through the auxiliary cover 204, as shown in FIG. 3. It is important and necessary for the top surface member 210 of the flexible amperage flag 206 to be visible through the auxiliary cover 204 so that an operator can readily learn the amperage rating of the circuit breaker 200 indicated or printed on the top surface member 210 (such as 60 A, 150 A, or 250 A). The amperage flag 206 is also visible through the panelboard trim (not shown) into which the circuit breaker 200 is installed. The amperage flag 206 is attached to the trip unit 202 via the attachment member 214, allowing different trip units of different amperage ratings to be installed into the same circuit breaker 200 housing.

FIG. 3 is an isometric view of the circuit breaker 200 having a base 226 into which the trip unit 202 is installed, and the auxiliary cover 204 is positioned over the base 226 to house the trip mechanism and other components for the circuit breaker 200. A handle 232 conventionally protrudes through the auxiliary cover 204 for indicating a status (on, off, or tripped) of the circuit breaker 200. The trip unit 202 and the auxiliary cover 204 abut against each other at the interface

218. This interface 218 can be compromised during an arcing explosion following a tripping of the circuit breaker's trip mechanism as the movable contacts separate. Sudden, intense gas pressure is generated within the circuit breaker 200, forcing the trip unit 202 and the auxiliary cover 204 away from one another, which puts a strain on the flexible amperage flag 206 as it moves with the auxiliary cover 204. The thin, flexible leg 220 allows the amperage flag 206 to flex with the forces exerted thereupon, preventing damage to the amperage flag 206. The amperage flag 206 can thus reliably indicate the amperage rating of the trip unit 202 notwithstanding repeated interruptions of current by the circuit breaker 200.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A flexible amperage flag for use in a circuit breaker, comprising:

a flexible amperage flag extending through an aperture in a cover of the circuit breaker such that a top surface member of the flexible amperage flag is visible from an exterior of the cover, the flexible amperage flag including:

an attachment member attached to a trip unit of the circuit breaker, the trip unit being adjacent to the cover;

a first flexible leg coupled to the attachment member, the first flexible leg being coupled to the top surface member, the first flexible leg non-frangibly flexing in response to movement of the cover away from the trip unit in response to tripping of the trip unit responsive to detection of an electrical fault.

2. The flag of claim 1, wherein the first flexible leg has a length longer than a width, the length of the first flexible leg extending in a direction parallel to a wall of the trip unit from which the attachment member extends.

3. The flag of claim 1, wherein the attachment member extends away from a wall and is generally orthogonal to a length of the first flexible leg, the length of the first flexible leg being longer than a width thereof.

4. The flag of claim 1, wherein the circuit breaker has a molded case composed of plastic.

5. The flag of claim 1, wherein the top surface member indicates an amperage rating of the trip unit.

6. The flag of claim 1, wherein the flexible amperage flag is integral with a housing of the trip unit, the housing including the wall of the trip unit such that the flexible amperage flag and the housing of the trip unit are molded as a single component.

7. The flag of claim 1, wherein the first flexible leg has a length longer than a width, the length of the first flexible leg extending in a direction parallel to the wall of the trip unit to which the attachment member is attached, the top surface member indicating an amperage rating of the trip unit, and wherein the flexible amperage flag is integral with a housing of the trip unit, the housing including the wall of the trip unit such that the flexible amperage flag and the housing of the trip unit are molded as a single component.

8. A trip unit for use in a circuit breaker, comprising:

a housing having a wall adjacent to an auxiliary cover of the circuit breaker;

a flexible amperage flag extending through an aperture in the auxiliary cover such that a top surface member of the flexible amperage flag is visible from an exterior of the auxiliary cover, the flexible amperage flag including:

an attachment member attached to the wall of the trip unit;

a first flexible leg coupled to the attachment member, the first flexible leg being coupled to the top surface member, the first flexible leg non-frangibly flexing in response to movement of the auxiliary cover away from the trip unit in response to tripping of the trip unit responsive to detection of an electrical fault.

9. The trip unit of claim 8, wherein the first flexible leg has a length longer than a width, the length of the first flexible leg extending in a direction parallel to the wall of the trip unit to which the attachment member is attached.

10. The trip unit of claim 8, wherein the auxiliary cover abuts against the wall of the trip unit.

11. The trip unit of claim 8, wherein the circuit breaker has a molded case composed of plastic.

12. The trip unit of claim 8, wherein the flexible amperage flag is integral with the housing of the trip unit, the flexible amperage flag and the housing of the trip unit being molded as a single component.

13. The trip unit of claim 8, wherein an amperage rating of the trip unit is indicated on the top surface member.

14. The trip unit of claim 8, further comprising a handle protruding through the auxiliary cover, the handle operable to indicate a status of the circuit breaker.

* * * * *